US005471222A

United States Patent [19]

Du

[11] Patent Number: 5,471,222

[45] Date of Patent: Nov. 28, 1995

[54] ULTRAHIGH FREQUENCY MOBILE ANTENNA SYSTEM USING DIELECTRIC RESONATORS FOR COUPLING RF SIGNALS FROM FEED LINE TO ANTENNA

[75] Inventor: Xin Du, Glen Ellyn, Ill.

[73] Assignee: The Antenna Company, Itasca, Ill.

[21] Appl. No.: 128,367

[22] Filed: Sep. 28, 1993

[51] Int. Cl.[6] ..... H01Q 1/32; H01Q 1/50

[52] U.S. Cl. ..... 343/713; 343/715; 343/860

[58] Field of Search ..... 343/713, 715, 343/850, 860–862; 333/219.1; H01Q 1/12, 1/27, 1/32, 1/50, 9/30

[56] References Cited

U.S. PATENT DOCUMENTS

| | | | |
|---|---|---|---|
| Re. 33,743 | 11/1991 | Blaese | 343/715 |
| 2,890,422 | 6/1959 | Schlicke | 333/77 |
| 4,089,817 | 5/1978 | Kirkendall | 343/713 |
| 4,238,799 | 12/1980 | Parfitt | 343/715 |
| 4,593,460 | 6/1986 | Gannon et al. | 29/602 R |
| 4,613,833 | 9/1986 | Harada | 343/715 |
| 4,764,773 | 8/1988 | Larsen et al. | 343/713 |
| 4,785,305 | 11/1988 | Shyu | 343/713 |
| 4,821,006 | 4/1989 | Ishikawa et al. | 333/202 |
| 4,839,660 | 6/1989 | Hadzoglou | 343/715 |
| 4,857,939 | 8/1989 | Shimazaki | 343/715 |
| 4,939,484 | 7/1990 | Harada | 333/24 R |
| 4,992,800 | 2/1991 | Parfitt | 343/713 |

OTHER PUBLICATIONS

Harrison, "A Miniature High–Q Bandpass Filter Employing Dielectric Resonators", IEEE Transactions on Microwave Theory and Techniques, vol. MTT–16, No. 4, Apr. 1968.

Cohn, "Microwave Bandpass Filters Containing High–Q Dielectric Resonators", IEEE Transactions on Microwave Theory and Techniques, vol. MTT–16, No. 4, Apr. 1968.

Pospieszalski, "Cylindrical Dielectric Resonators and Their Applications in TEM Line Microwave Circuits", IEEE Transations on Microwave Theory and Techniques, vol. MTT–27, No. 3, Mar. 1979.

Fiedziuszko, "Double Dielectric Resonator", IEEE Transactions on Microwave Theory and Techniques, vol. MTT–19, No. 9, Sep. 1971.

*Primary Examiner*—Michael C. Wimer

*Attorney, Agent, or Firm*—Lockwood Alex Fitzgibbon & Cummings

[57] ABSTRACT

An improved glass mount antenna system employs a pair of high dielectric constant, high Q, low loss dielectric resonators for TE011 and TE111 resonance mode coupling to couple RF energy through the glass to thereby provide an omni-directional communication antenna system characterized by high radiation efficiency and low pattern distortion. The antenna assemblies are especially well suited for high frequency communication operations, for example at microwave bands of between about 1.5 GHz to 2.4 GHz, currently contemplated for PCN/PCS communications.

32 Claims, 5 Drawing Sheets

ULTRAHIGH FREQUENCY MOBILE ANTENNA SYSTEM USING DIELECTRIC RESONATORS FOR COUPLING RF SIGNALS FROM FEED LINE TO ANTENNA

BACKGROUND OF THE INVENTION

The present invention relates to communication antennas and to RF signal transmission through a dielectric barrier. More particularly, it relates to a new and improved glass mount mobile vehicle antenna system employing very high Q, high dielectric constant, low loss dielectric resonators, together with an elevated feed antenna to couple RF energy through the glass via resonance mode coupling of the resonators to minimize coupling losses and to provide an improved omni-directional communication antenna system having high radiation efficiency and low pattern distortion.

Technological advances in personal communication services and products have been astounding. The development of personal paging/beeper systems and mobile cellular telephone systems are prominent examples of these developments. An ultimate technological goal in this field envisions individuals carrying small, inexpensive hand-held communicators and being reachable by voice or data with a single phone number, no matter where they are. This new system, generally referred to as a Personal Communications Network (PCN)/Personal Communications System (PCS), is a wire- less, "go anywhere" communicator system which eliminates the need for separate numbers for the office, home, pager, facsimile or car. Many national and international bodies responsible for regulating communications networks and for working out international communication standards have generally set aside a portion of the ultra-high frequency microwave radio spectrum within the band from about 1.5 GHz to about 2.4 GHz as the bandwidth range dedicated for PCN/PCS communication systems. The present invention is directed to mobile antennas and especially window mounted mobile vehicle antennas for use in any communications system, but which are especially adapted for use in the high frequency operating ranges intended for PCN/PCS communications.

Glass mount mobile antennas for use in cellular mobile telephones, for example, are known which mount on the window of the vehicle, thereby avoiding the need to drill holes in or otherwise modify the vehicle body. Window mounted antennas include an outside module on the outside of the window glass on which a generally vertical radiating element is mounted and an inside module inside the glass disposed in registration with the outside module which contains an impedance matching circuit and in some instances, a ground plane, as necessary, for operation of the antenna. Consumers have welcomed the through-glass mounted antennas because it is no longer necessary to drill a hole through the vehicle which detracts from the vehicle's value. However, the blocking effect of the passenger compartment, coupled with through glass signal losses occurring with most glass mount antennas, provides an antenna having a lower gain and a higher pattern distortion than the roof-mounted antenna. Gain, for example, is normally in the 1–3 dB range. Most cellular telephone communications occur at operating frequencies of about 800 MHz. Even at these lower frequencies, improved coupling efficiency and lower distortion is desired.

Efforts at improving the performance of prior art glass mount mobile antennas have employed capacitive couplings through the vehicle glass and low-Q circuits involving LC impedance matching networks. For example, in U.S. Pat. No. 4,089,817 to Kirkendahl, a capacitively coupled antenna system is described. The capacitive coupling consists of electrical patches on both sides of the automobile glass, such as a windshield or window, which forms a capacitor to couple the RF energy. In U.S. Pat. No. 4,839,660 to Hadzoglou, an improved structure including a moderate coupling impedance wherein the bottom radiation element is close to a complete half-wave dipole is described. A full-dipole radiation element cannot be used because of the high transmission impedance sensitivity at one half wavelengths. Other illustrative examples of glass mount antennas employing different circuits to provide impedance matching networks for capacitive couplings include U.S. Pat. No. 4,992,800 to Parfitt; U.S. Pat. No. 4,857,939 to Shimazaki; and U.S. Pat. No. 4,785,305 to Shyu.

Each of these previous efforts to provide capacitive coupling by positioning electrical patches on both sides of the vehicle glass presents a number of attendant disadvantages. The electrically conductive patches generally may not be made large enough in comparison with the operating wavelength to keep it from being the primary radiating element. Accordingly, only high impedance couplings on the order of several hundred Ohms may only be provided which leads to high losses due to leakage of the electrical field at higher frequencies. At higher frequency bands like the proposed PCN/PCS band, even a small conductive patch is no longer effective to act as a lump capacitor element considering the thickness of the vehicle glass. A capacitance PI circuit bypasses the signal and makes it more difficult to match the high impedance of the antenna to a 50 Ohm system. In U.S. Pat. No. 4,764,773 to Larsen, an improved coupling structure is proposed, including two patches to reduce the coupling impedance. The Larsen antenna, however, still suffers from having the capacitor coupling limitation of requiring small patch sizes. At higher operating frequencies, this problem still exists or is exacerbated.

For mobile communications, it is critical to provide an antenna system having low pattern distortion. A whip collinear antenna does not always have a uniform current distribution. Frequently, a lower section has the strongest radiation. In a real-life automobile or other vehicle situation, the lower section of these antennas is actually blocked by the roof of the vehicle, causing severe pattern distortion and deep null. This situation is made worse at the higher proposed frequencies for PCN/PCS because the length of the radiators are only half that of the cellular band radiator, due to the doubling of the operating frequencies. A collinear array having a high feeding point, is normally provided by applying a de-coupling sleeve or by means of slot technology. These antennas normally have a 50–75 Ohm impedance which makes it difficult to adapt these antennas to the capacitively coupled prior art structures. As a result, outside impedance matching networks must be used to achieve a 50–50 Ohm transmission and even higher losses are expected at-the higher PCN/PCS frequency bands when these at conventional LC circuits are employed.

Another major shortcoming of prior art capacitively coupled antenna systems is that these kinds of systems suffer strong spurious emission to the passenger compartment simply because the whip collinear array needs a ground plane. Prior art methods used to isolate the feeding line from environmental radiation have relied on the couplers themselves to act as an impedance matching network. For example, in the above-mentioned Hadzoglou and Kirkendall patents, the coupling patches are part of the antenna's impedance matching network. In U.S. Reissue Patent 33,743 to Blaese, another capacitively coupled antenna system is described which attempts to couple the coaxial cable through the glass. At high frequency PCN/PCS bands the proposed ¼ wave antenna would be only about 1.7 inches long, which would lie completely below the roofline of the vehicle causing severe pattern distortion and deep null. In U.S. Pat. No. 4,939,484 to Harada, a coupler including helix cavities is used to couple the signal through the glass. Unfortunately, the aperture is fixed to satisfy the ⅓ object frequency, as described in the Harada patent. For an 800 MHz cellular application, the helix should be designed for a 200 MHz frequency which has a Q factor of over 1,000 and enough coupling aperture. However, at a 1.8 GHz frequency band, the helix must be designed for 600 MHz. A 600 MHz helix cavity will have a small aperture of only about half that of the cellular band. A significant drop of unloaded Q is unavoidable, due to the thin helix and the coupling coefficient is not sufficient to keep a 10% band width. Other drawbacks of the helix cavity approach described in the Harada patent are that in the proposed antennas, it is difficult to tune the frequency of the antenna system and it is difficult to manufacture the antennas because of its complicated structure.

Generally, the performance of the prior art antenna systems degrades considerably as frequencies approach the 1.5 GHz to 2.4 GHz range proposed for PCN/PCS communications. The prior art antennas and systems are relatively low frequency systems, when compared to microwave frequencies and they all employ low Q, lumped LC elements, or semi-lumped elements provided by placing the LC elements in metal enclosures. At the higher PCN/PCS frequencies, the losses of LC circuits will increase considerably due to the low, unloaded Q nature of the prior art systems and components. The PCN/PCS communication systems must operate at low power levels of about 1 Watt and provide a very wide range of coverage at very high frequencies. The prior art antenna systems are inappropriate for satisfying these requirements because of their low frequency approaches.

It is known in the filter arts that certain dielectric resonators may be used to build high-quality, narrow-banded filters, typically less than 2%. In filter applications, the dielectric resonators are normally placed in a continuously conductive enclosure to minimize any losses which may arise due to spurious modes or leakage. Illustrative dielectric resonators are described in U.S. Pat. No. 2,890,422 to Schlicke. The dielectric resonators have very good long-term stability so that component aging effects are negligible. The high density nature of the resonators reduces the undesirable effects of moisture to a minimum. Even at high frequency bands around 1.8 GHz, dielectric resonators may still maintain an unloaded Q factor of greater than about 3,000. In contradistinction, the helix cavities with a 600 MHz based frequency described in the Harada patent, cannot achieve such a high Q factor. The hollow-cavity helix systems described in the patent are more sensitive to the environment than dielectric resonators and special sealing is required to keep the Q from dropping further. Furthermore, it is impossible to keep sufficient coupling coefficient for a small helix aperture through a vehicle glass having a thickness from about 4 to about 6 mm, plus the thickness added by any adhesive mounting pads. The dielectric couplers solve the aperture problem of the Harada patent because the dielectric constant can be selected. For example, at 1.8 GHz, a dielectric resonator with a dielectric constant of 80 available commercially from Trans-Tech, Inc. under the trade designation 8600 Series has a dimension of D=24 mm, and h=7.6 mm. At 2.4 GHz, a dielectric resonator with constant of 38 also commercially available from Trans-Tech, Inc. under the designation Series 8800 may be used which has the dimensions D=24 mm and h=9.6 mm, which still provides a large enough aperture to maintain the coupling coefficient at a desirable level. On the other hand, an 800 MHz base frequency helix may have only a 10 mm aperture.

Accordingly, to overcome the shortcomings and disadvantages of the prior art systems and devices, it is an object of the present invention to provide a new and improved glass mount antenna system.

It is another object of the present invention to provide a glass-mount antenna system adapted to operate at upper UHF and higher microwave frequencies exhibiting greater coupling efficiency and less pattern distortion than has heretofore been achieved.

It is a further object of the present invention to provide a coupling scheme including a new and improved tuneable wide band coupling structure which provides flexible impedance matching to permit the feeding point of the antenna to be raised easily.

It is still another object of the invention to provide an antenna system having improved emission performance by employing twin enclosed cavities containing moisture-insensitive, high Q dielectric resonators and by implementing a feeding line isolating choke at the antenna end.

It is still a further object of the present invention to provide a glass-mount antenna system employing a resonance mode coupling, such as TE011 and TE111 modes, instead of electrical capacitance or inductance couplings.

It is still another object of the present invention to provide a high performance omni-directional PCN/PCS communication antenna system capable of coupling high frequency RF energy through a dielectric wall without the need for a continuously conductive enclosure and without significant losses.

SUMMARY OF THE INVENTION

In accordance with these and other objects, the present invention provides a new and improved antenna apparatus for mounting on the window of the vehicle which is adapted for operation in conjunction with a utilization device, such as a communication device, located within the vehicle. More particularly, the antenna apparatus comprises an exterior module and an interior module. The exterior module includes a first electrically conductive shroud member defining a first shielded cavity. The module additionally includes an elongated radiating element. A first low-loss, high Q dielectric resonator element adapted for resonant mode coupling is disposed in the first shielded cavity. Means are provided for electrically coupling the radiating element to the first dielectric resonator. Furthermore, means are provided for mounting the exterior module to an outside surface of the vehicle window so that the radiating element is disposed in an elevated feeding position.

The antenna apparatus additionally comprises an interior module which includes a second electrically conductive shroud member defining a second shielded cavity. A second low loss, high Q dielectric resonator element is disposed in the second shielded cavity and is adapted for resonant mode coupling with said first dielectric resonator. A coaxial feed line including an inner conductor and an outer conductive shield is provided for electrically coupling the interior module to said utilization device. The inner conductor of the feed line is electrically coupled to the second dielectric resonator. The outer conductive shield is electrically coupled to the second conductive shroud member. Means are provided for mounting the interior module to the inside surface of the vehicle window in general alignment with the exterior module so that the first dielectric resonator and the second dielectric resonator are disposed substantially in registration.

In accordance with the preferred embodiment of the invention, both the exterior module and the interior module are additionally provided with an electrically nonconductive dielectric outer housing adapted to surroundingly engage and protect the first and second electrically conductive shroud members. The preferred radiating elements will comprise semi-rigid coax-sleeve dipole type radiating elements. Semi-rigid coax-sleeve dipole antennas having at least one RF choke end portion are especially preferred. The dielectric resonators for use in the antenna apparatus for this invention may comprise dielectric resonators having a dielectric constant of at least about 80 and a Q factor of at least about 3000. Especially preferred dielectric resonators are cylindrical ceramic materials selected from Barium-Titanium-a Lanthanide Series element- (and optionally lead) oxide ceramics, such as, Ba-Ti-Pb-Nd oxide ceramic and Ba-Pb-Ti oxide ceramic materials. Ceramics of this type are commercially available from sources such as Trans-Tech, Inc. and Murata Erie North America Company. Additionally, for ultra-high frequency uses the ceramic may have a lower dielectric constant of about 38 and a Q factor of at least about 30,000. In accordance with the preferred embodiment, the inner or core conductor of the coax radiating element is electrically coupled to the first dielectric resonator and the outer radiator shield is electrically coupled to the first shroud member. In accordance with the preferred embodiment, the cylindrical ceramic dielectric resonators will have an aspect ratio, i.e. a length to diameter ratio (L/D) of less than about 0.4 to provide a satisfactory coupling coefficient. In especially preferred embodiments, large bandwidths are provided by employing metallic strip exciters disposed adjacent the ceramic resonators and between the resonators and the adjacent shroud walls.

In accordance with this invention, resonance mode coupling, such as TE011 and TE111 modes, instead of electrical capacitance or inductance coupling, provides a superior through glass antenna system for use at most frequencies and especially at high frequencies. More particularly, the vehicle glass is a dielectrical material which introduces considerable dielectric loss at high frequencies for electrical fields, but very low losses for concentrated TE011 and TE111 magnetic fields. TE011 and TE111 modes have very low loss and the E,H field distributions make them very suitable for the glass coupler applications. In accordance with this invention and utilizing this coupling method, high performance antenna systems for providing omni-directional communication with high radiation efficiency and low-pattern distortion are provided, especially at PCN/PCS frequencies of above about 1.5 GHz and preferably between about 1.5 GHz and 2.4 GHz.

Further objects and advantages of the invention will become apparent from the following Detailed Description of the Preferred Embodiment taken in conjunction with the Drawings, in which:

DETAILED DESCRIPTION OF THE PREFERRED EMBODIMENTS

Figure 1:
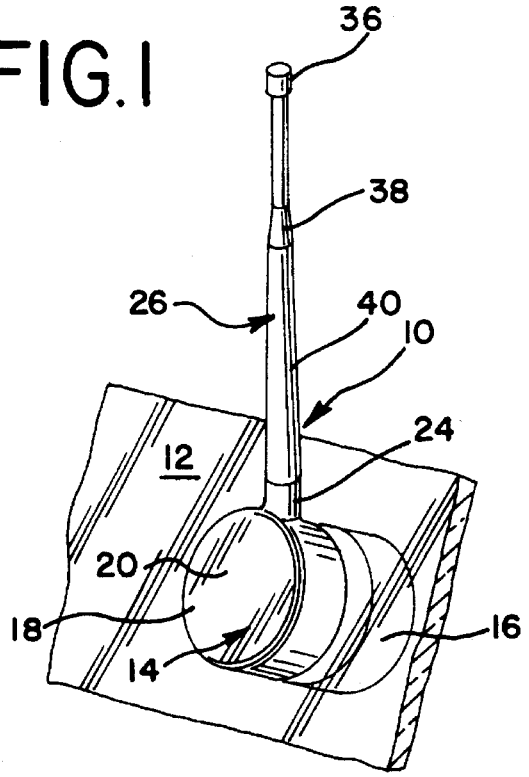
FIG. 1 is a perspective view of the new and improved resonant mode through glass antenna apparatus in accordance with the preferred embodiment of the invention shown in use in a mounted position on an automobile windshield.

Referring now to FIGS. 1–4, a preferred embodiment of the new and improved antenna apparatus in accordance with this invention, generally referred to by reference numeral 10 is shown. As shown in the figures, the antenna apparatus 10 includes an exterior module assembly 14 and an interior module assembly 16 mounted on a vehicle window 12. The vehicle window 12 may comprise any dielectric window member within the vehicle and preferably will comprise a front or rear wind screen with the antenna apparatus 10 mounted adjacent an upper roof portion thereof.

Exterior module 14 includes an outer dielectric housing member 18 having a generally hollow cylindrical configuration with a closed end 20 and an opposed open end 22. A tubular angled radiator mounting sleeve 24 projects outwardly at an angle from the dielectric housing 18. The angle of the mounting sleeve 24 is preferably selected so that in its installed condition, the radiating element 26 is disposed in an elevated feed position, preferably above the vehicle roof.

As depicted in the preferred embodiments shown in FIGS. 1–4, a margin portion of the housing surrounding open end 22 is provided with a lip 28 having a latch-receiving recess 30 defined therein. The dielectric housing 18 may comprise any relatively non-conducting dielectric thermoplastic polymer. Preferably, the dielectrical housing comprises a shaped or molded polycarbonate member.

In accordance with the preferred embodiments depicted in FIGS. 1–4, the radiating element 26 will comprise a semi-rigid coax sleeve dipole radiator including an outer shield member 32 and an inner conductor 34. The coax dipole radiator element 26 includes an outwardly projecting free end 36 provided with an RF choke 38. The radiator 26 is preferably protectively covered in a dielectric sleeve 40 which may be made of any suitable thermoplastic polymer material, such as a thermoplastic polyester or a polyolefin. The protective sleeve 40 in accordance with the preferred embodiment is adapted for a slidable press-fit engagement onto the mounting sleeve 24 of dielectrical housing 18. The outer shield 32 and inner conductor 34 from radiator element 26 extend through an interior portion of mounting sleeve 24 to make an appropriate electrical coupling to other members of the exterior module 14, to be more particularly described hereinafter.

In accordance with this invention, the exterior module 14 additionally comprises a first electrically conductive shroud member 42 having a hollow open-ended cylindrical configuration including a closed end wall 44 and an opposed open end 46. A plurality of cap mounting notches or grooves 48 are provided in the sidewall of shroud member 42 adjacent open end 46. An aperture or feed hole 50 extends through a sidewall portion of shroud member 42 to permit the insulated inner conductor 34 from the radiator element 26 to pass therethrough. The outer shield conductor 32 of radiator element 26 is electrically coupled to the shroud member 42. Shroud member 42 defines a shielded recess or cavity 52 within the exterior module 14. Shroud member 42 should be configured to be closely telescopically received through the open end 22 of the dielectrical housing 18. Shroud member 42 may be made from any suitable electrically conductive material and, in accordance with the preferred embodiment depicted herein, the shroud member 42 is made of a brass alloy.

Exterior module 14 further includes a dielectric planar substrate 54 such as a printed circuit substrate having a cylindrical projecting mounting pin 56 extending from outwardly from one major surface 60 thereof. In accordance with the preferred embodiment, a loop-shaped conductive region 58 forming an exciter strip is provided on major surface 60 of planar substrate 54. The dielectric substrate 54 may comprise any suitable dielectrical material although low loss materials such as ULTEM® polyetherimide or other electrical grade thermoplastic polymer, such as polystyrene, may be used. The conductive exciter strip 58 may be in a looped configuration or a straight strip configuration and may be plated onto the planar substrate 54 or may comprise a separate metallic member affixed to major surface 60 of the substrate 54 by any suitable means such as, for example, by means of an adhesive. The planar substrate 54 in accordance with the preferred embodiment has a thin cylindrical or disc shaped configuration having a diametrical dimension selected to be closely telescopically received in the first shroud member 42 so that a second major surface 62 is disposed in abutting face-to-face relation with the closed end 44 of shroud member 42.

The thickness dimension of the planar substrate 54 is selected so that the exciter strip 58 is spaced a predetermined distance from the closed end 44 of the shroud member to define a desired impedance therebetween. The inner conductor 34 from the coax radiating element 26 is electrically coupled to the conductive metal strip 58 on the first major surface 60 of the planar substrate 54. Any suitable electrical coupling means may be used to achieve this result.

In accordance with the preferred embodiment, the exterior module 14 additionally comprises a dielectric resonator element 66 having a generally cylindrical configuration provided with a central core aperture 68 extending therethrough. Resonator element 66 is preferably a low-loss, high dielectric constant, high Q dielectric resonator made from ceramic materials having a dielectric constant of at least from about 75 to 100 and preferably at least about 80. Resonator element 66 may be slidably received on mounting pin 56 of the planar substrate 54 so that a major end wall surface 70 thereof is disposed adjacent to the conductive region 58 comprising the exciter strip defined on major surface 60 of planar substrate 54. Optionally, but preferably, a small amount of a suitable adhesive material may be disposed about the mounting pin 56 and core aperture 68 to maintain end surface 70 of resonator 66 in adjacent spaced relation to the exciter strip 58.

Figure 2:
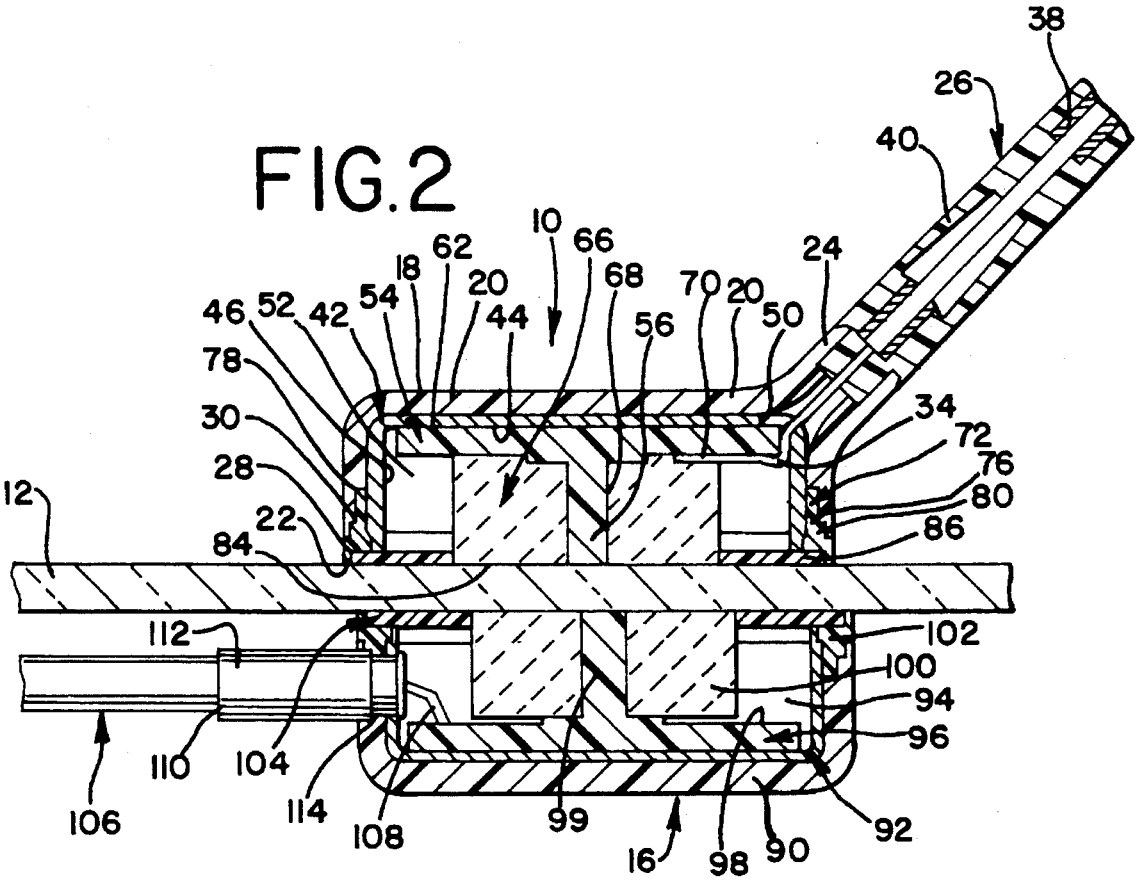
FIG. 2 is an elevated cross-sectional view of the new and improved antenna apparatus of the invention shown in FIG. 1.
Figure 3:
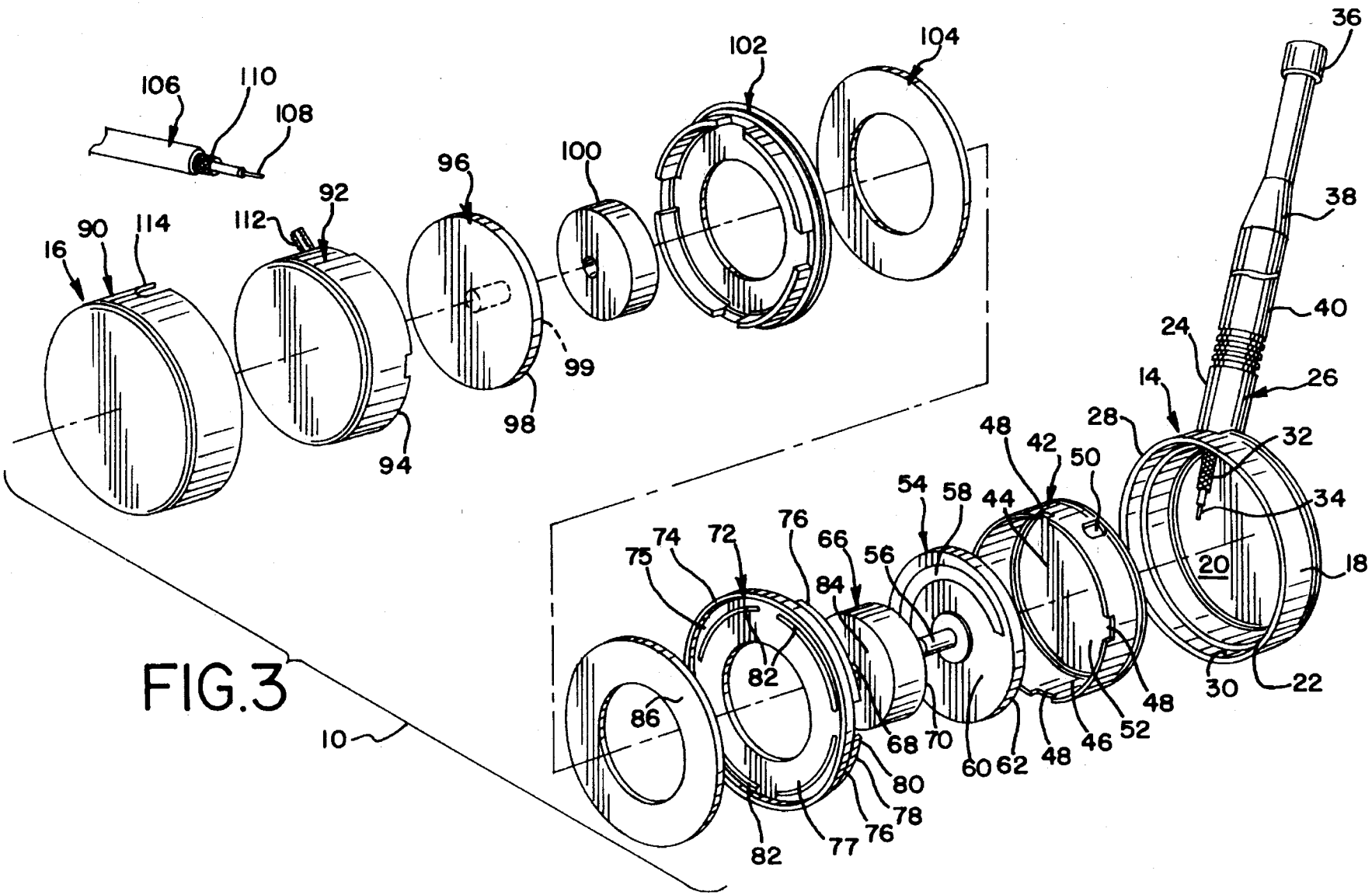
FIG. 3 is an exploded perspective view of the antenna apparatus in accordance with the preferred embodiment.
Figure 4:
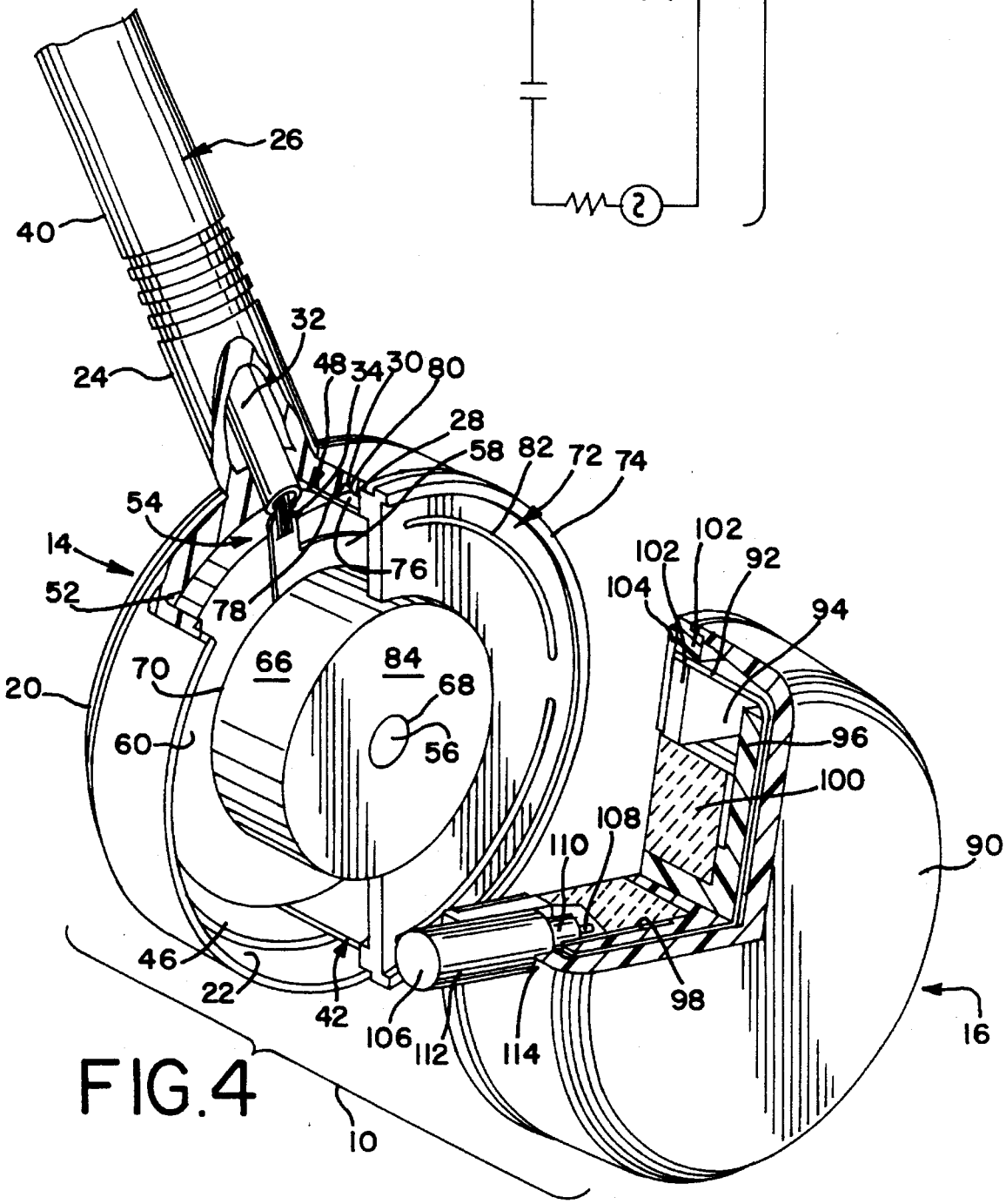
FIG. 4 is a perspective view with portions cut away to reveal the structure of the exterior module and the interior module of the new and improved antenna apparatus of the present invention shown in their respective assembled form.

In accordance with the preferred embodiment depicted in FIGS. 1–4, exterior module 14 additionally comprises a thermoplastic cap member 72 having a thin disk-like cylindrical configuration. Cap member 72 includes a raised forwardly projecting lip 74 defining an adhesive-receiving recess region 75 on an outwardly facing major surface 77 thereof. Cap member 72 additionally includes a plurality of rearwardly projecting curved latch arms 76 each provided with free end portion 78 equipped with cooperating locking latches 80 intended to releasably engage the groove recess 30 provided in lip 28 on dielectric housing 18 to secure the exterior module 14 in a fully assembled condition. Cap member 72 includes a plurality of curving slots 82 defined radially inwardly from an edge portion thereof which are adapted to receive the raised edge portions defined between adjacent notches 48 in first shroud member 42. In the fully assembled condition as shown in FIGS. 2 and 4, the second major surface 84 of resonator 66 is positioned for flush mounting in face-to-face contact against the outside surface of vehicle window 12.

In accordance with the preferred embodiment depicted in FIGS. 1–4, a means for mounting the exterior module 14 to the vehicle window 12 preferably comprises an adhesive pad material 86 having adhesive bonding capabilities disposed on opposed surfaces thereof. A preferred adhesive pad 86 comprises an acrylic foam adhesive available from 3M Company.

In accordance with this invention, the new and improved antenna apparatus 10 additionally comprises an interior module 16 composed of component elements very similar to those comprising the exterior module 14. More particularly, and as best shown in FIGS. 1–4, the interior module 16 includes a second dielectrical housing 90 adapted to receive a second electrically conductive shroud member 92 to define a shielded cavity 94 within the interior module 16. A planar printed circuit substrate 96 provided with an electrically conductive region 98 thereon is provided which also includes a positioning pin 99 extending therefrom. A second dielectrical resonator 100 is provided within the shielded cavity 94 of the interior module 16 to provide resonance mode coupling in TE011 mode with the dielectric resonator 66 of the exterior module 14. Interior module 16 additionally includes a thermoplastic polymer cap member 102 provided with the releasable cooperative locking features to maintain the interior module 16 in fully assembled condition. An O-ring shaped adhesive pad 104 is also provided on an outer facing surface of the cap member to securely mount the interior module 16 against the inner surface of the vehicle window 12. The interior module 16 is adapted for electrical coupling to a coaxial feeder cable 106 including an inner insulated conductor 108 and an outer conductive shield 110. A crimp ferrule-type connector 112 extends outwardly from a sidewall of second shroud member 92 and through a groove or recess 114 provided in dielectrical housing 90. The conductive outer shield 110 of the coaxial feed cable 106 is electrically connected or coupled with the second shroud member 92 and the inner conductor 108 is electrically coupled to the conductive region 98 provided on planar substrate 96. The remote end of the coaxial feeder line 106 is in turn electrically coupled to the utilization device, such as a communication system, provided within the vehicle.

Figure 5:
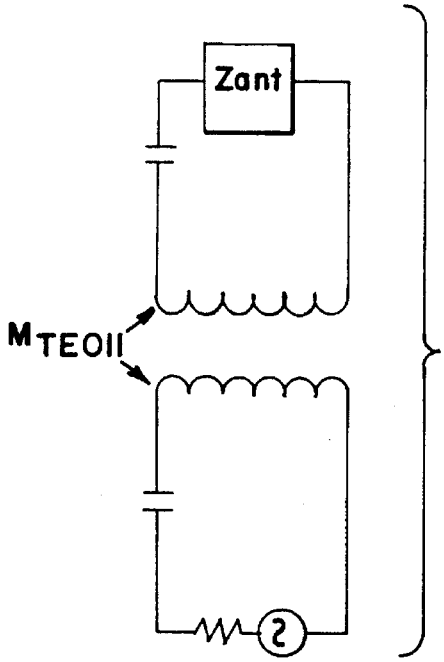
FIG. 5 is a simplified electrical schematic diagram of the new and improved antenna of this invention.

Referring now to FIG. 5, a schematic simplified diagram of the antenna system provided by the present invention is shown. The antenna system 10 of this invention relies upon more efficient RF coupling through resonance mode coupling of the two matched dielectric resonators such 66 and 100 to provide a high performance omni-directional communication antenna.

In accordance with this invention, the exterior module 14 and interior module 16 are mounted on opposed surfaces of vehicle window 12 in general alignment with each other so that the dielectrical resonators 66 and 100 are disposed substantially in registration with each other.

The new and improved microwave dielectric resonators 66 and 100 used in the antenna apparatus 10 of this invention have very low loss and high Q values in comparison with the LC lumped circuits and distributed transmission line systems of the prior art. In glass-coupled antenna contexts, it is an important feature to minimize the surface current on the sidewall of the metal closures defined by first and second shroud members 42 and 92, respectively. This is important because there is no overall common enclosure in a glass mount, through window antenna situation. Accordingly, the dielectric constant of the resonators must be sufficiently high and the electromagnetic field distribution must be appropriately considered in selecting the appropriate resonance mode.

In accordance with this invention, it is an important structural aspect to attempt wherever possible to avoid cutting surface current. For this reason, high dielectric constants for the dielectric resonators 66 and 100 are required and ceramic resonators are especially preferred. For this specification application, Barium and Titanium based oxide ceramics including at least one Lanthanide Series component and optionally a lead component such as Ba-Pb-Nd-Ti Oxide ceramic or Ba-Pb-Ti Oxide ceramic materials are preferred because of their high dielectric constant values of 80 to 90. They also have high Q factors and the unloaded Q versus frequency for these materials can be approximately expressed as being from about 4500 to about 9000/f(GHz). For higher frequencies of operation, e.g., at or about 2.4 GHz, a Zr-Sn-Ti ceramic material may be used which has a lower dielectrical constant on the order of between about 20 to about 45 and preferably of about 38 but a Q factor having a much higher value of 40,000 per/f (GHz). Traditionally, aspect ratios (L/D ratios) for the dielectric resonators of L/D=0.4 were frequently used to insure that the nearest spurious mode was avoided. In the design context for the antenna apparatus of this invention, the glass wall effect should be considered in designing to suppress spurious modes and when using dielectrical resonator materials having a dielectrical constant of 80, an L/D ratio of less than 0.4 is generally suitable for almost all kinds of passenger vehicle glass.

In accordance with the preferred embodiments, the exciter strips 58 and 98 are employed in combination with the dielectric resonators to provide a wider bandwidth coupling. Preferably, the exciter strips 58 and 98 are selected to have an electrical length of less than about 0.25 waveguide wavelength and especially preferably will have an electrical length of about 0.22 waveguide wavelength. The impedance formed between the exciter strip 58 or 98 and the shroud end wall, such as 44 of the shroud member 42, may be selected to be from about 50 to 100 Ohms as required for any various antenna type.

Figure 6:
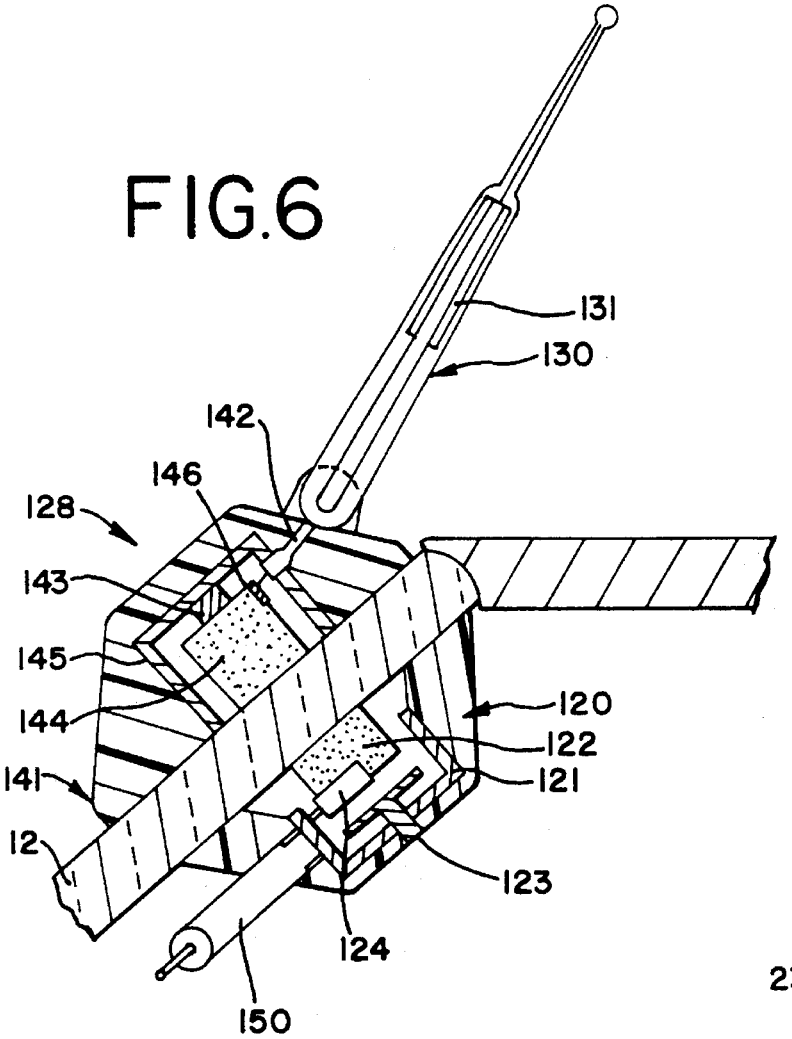
FIG. 6 is an elevated cross-sectional view of an alternate antenna system in accordance with the present invention shown in use mounted to an automobile windshield.

Referring now to FIG. 6, an alternate antenna apparatus 128 is shown. Antenna apparatus 128 includes a radiator or antenna member 130 selected from any kind of sleeve dipole or elongated collinear array type having at least one RF choke 131 disposed at an end portion thereof to isolate the feeding line emissions and to lift the feeding point above roof level on the vehicle. A soft, thin cable assembly 142 having an outside conductor connected to a conductive shroud and having an inner conductor soldered to the exciter strip comprises the outside feed line. The end of the cable is connected to the antenna member 130. Housings 120 and 141 have essentially the same structure. Dielectric resonator exciter assemblies are constructed in the shielded cavity formed by the cylindrical conductive shroud housings 121 and 145 with dielectric resonator members 122 and 144 mounted inside by a support 143 and a coupler body 120, respectively. The strip exciters 124 and 146 on the sidewalls of the resonators 122 and 144 are metal strip lines made by conventional printed circuit printing techniques or are metal strips attached to the resonator members 122 and 144. A cable 150 is the feeding line connected to the PCN/PCS transceiver. A tuning plate 123 in accordance with this embodiment, may be provided to trim the frequency of the overall apparatus 128. Alternatively, the distance between the resonators may be changed because the resonator pairs have a smooth tuning chart when spurious modes are successfully suppressed. A tunable antenna system of the type depicted in the antenna apparatus 128 may be more useful when the thicknesses of the glass window structures vary a great deal. Generally, however, a tuning plate moveable toward and away from the exciter strip 124 by rotation of a threaded screw member is optional and not generally necessary.

In accordance with this invention, the dielectric resonators may have a generally square configuration and be adapted for TE111 mode coupling. TE111 couplers may also be employed wherein the exciter strip is disposed on a side edge surface of the resonating element. By way of illustration only and not limitation, the square ceramic dielectric resonators may have dimensions of about 23 mm×23 mm×7.1 mm to provide resonators having a dielectrical constant of about 80 and useful at a 1.8 GHz band.

Figure 7:
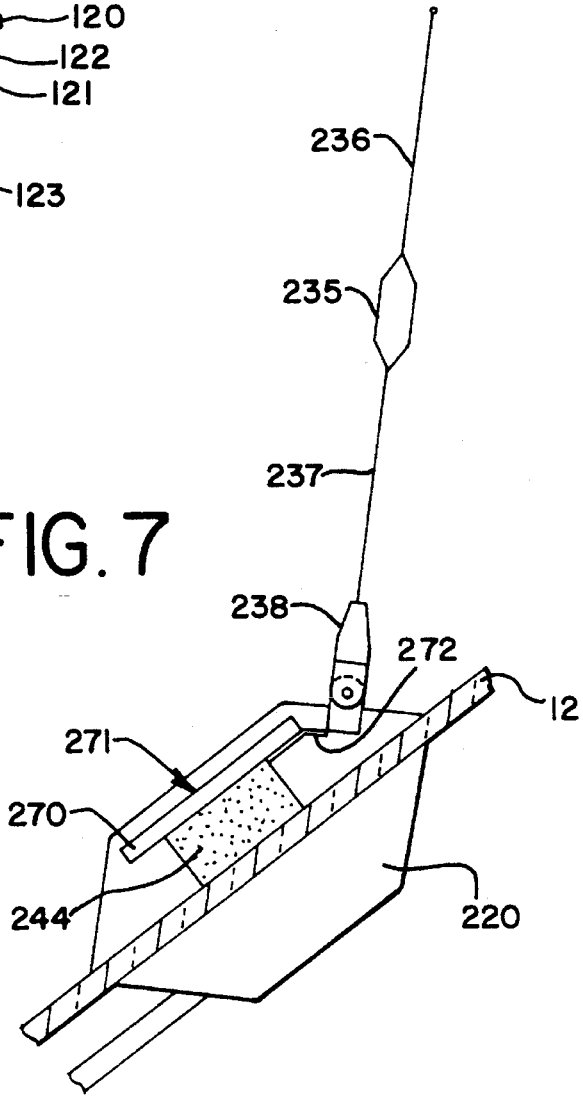
FIG. 7 is an elevated side-view partly in section showing another alternate embodiment of the new and improved antenna system of this invention.

Referring now to FIG. 7, the above described techniques are not limited to 50 to 50 Ohm couplings. By modifying the width of the strip exciter members, the antenna apparatus and coupling assembly may also work with regular whip collinear array radiators having a lower section length of nearly ½ wavelength or ⅝ wavelength. In the prior art, collinear arrays with a ⅝ wavelength lower section could not directly be used because the capacitively coupled design required that the load had to be inductive. As depicted in FIG. 7, an economical arrangement for a typical 3 dB collinear whip is shown. The collinear whip antenna is formed by elements 235 through 238 where 237 can either be ½ or ⅝ of wavelength in length. The element 238 is a swivel foot connected to the microstrip line member 272 which forms a ¼ wavelength loop exciter strip on substrate 270 which is adjacent to resonator element 244. Element 271 is the ground plane on the other side of the microstrip line. The impedance of the microstrip line can be from 50 to 75 Ohms and then tapered to the required antenna base impedance. The internal module coupling box 220 may generally be the same as those described above.

Figure 8:
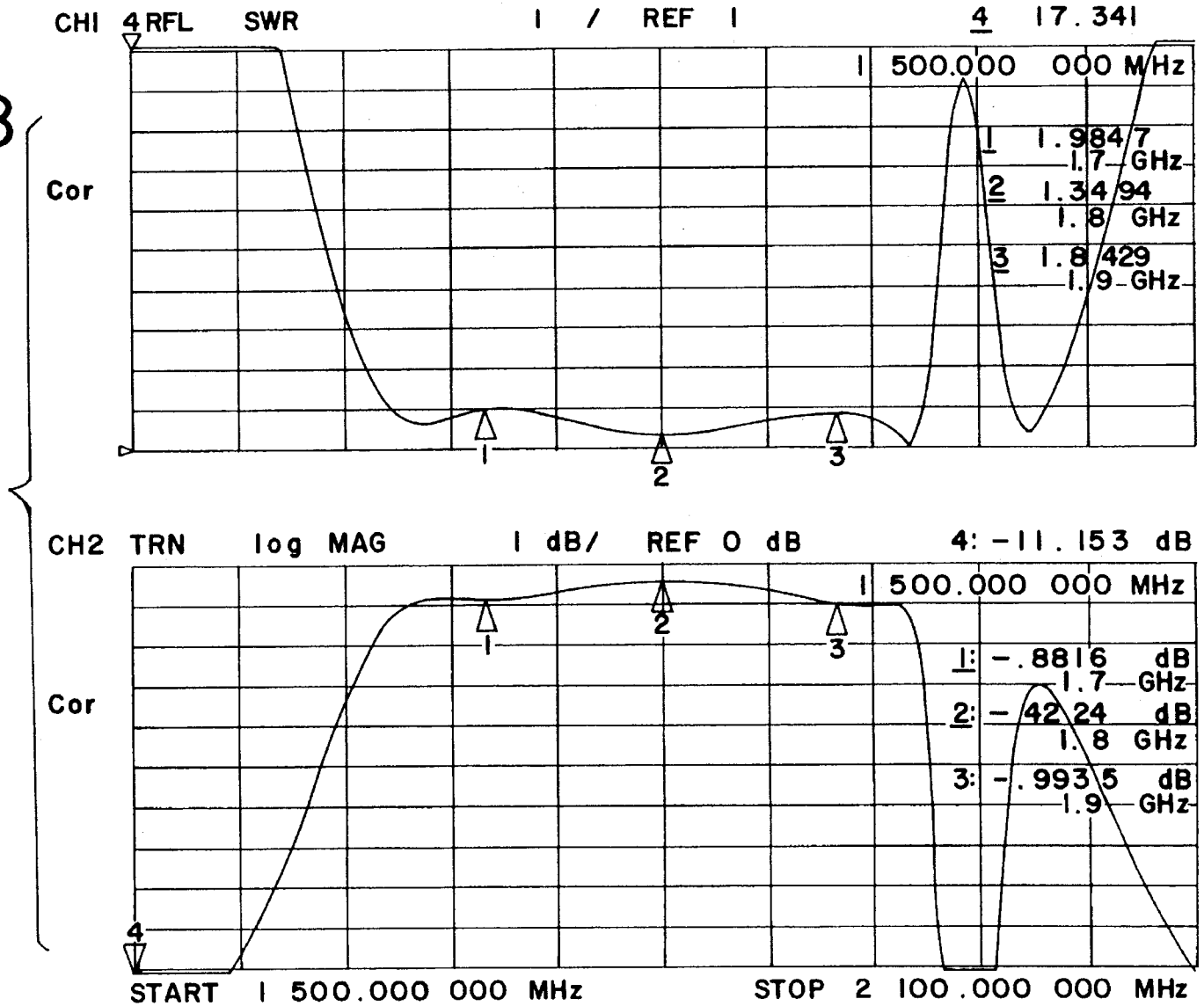
FIG. 8 is a graphical plot illustrating the insertion loss and corresponding VSWR plots of a TE011 symmetrical mode glass coupler antenna apparatus in accordance with the preferred embodiments shown at increasing frequency values from 1.7 GHz to 1.9 GHz.

Referring now to FIG. 8, a typical coupler used for PCN band in accordance with the present invention adapted for operating at frequencies ranging from about 1.7 GHz to 1.9 GHz shows that for the new and improved antenna apparatus 10 of this invention less than a 1 dB loss through a 6 mm thick windshield glass occurred over a bandwidth of 11% at 1.8 GHz. The curve shown in FIG. 8 indicate that the spurious response is kept away from the useful bandwidth. If a smaller bandwidth is preferred, the insertion losses can be made even smaller due to the high Q nature of the dielectric resonators.

Although the present invention has been described with reference to certain preferred embodiments, modifications and changes may be made therein by those skilled in this art without departing from the scope and spirit of the present invention as defined by the appended claims.

What is claimed is:

1. An antenna apparatus for mounting on a window of a vehicle and adapted for operation at frequencies of greater than or equal to about 1.5 Ghz in conjunction with a utilization device within the vehicle, said antenna apparatus comprising:

an exterior module including a first electrically non-conductive housing, a first electrically conductive shroud member disposed in said first housing and defining a first shielded cavity within said first housing, an elongated coaxial radiating element mounted to said first housing including at least one RF choke; a first dielectric resonator adapted for resonance mode coupling disposed in said first shielded cavity, means for electrically connecting a core conductor of said radiating element to said first dielectric resonator, means for electrically connecting a shielding sleeve portion of said radiating element to said first conductive shroud- and means for mounting said exterior module to an outside surface of said vehicle window with said radiating element disposed in an elevated feeding position above a roof portion of said vehicle; and an interior module including a second electrically non-conductive housing, a second electrically conductive shroud member disposed in said second housing and defining a second shielded cavity within said second housing, a second dielectric resonator adapted for resonant mode coupling disposed in said second shielded cavity, a coaxial feedline including a core conductor and an outer conductive shield for electrically connecting said interior module to said utilization device, said core conductor being electrically connected to said second dielectric resonator, said outer conductive shield being electrically connected to said second conductive shroud member; and means for mounting said interior module to an inside surface of said vehicle window in alignment with said exterior module such that said first and second dielectric resonators of said respective exterior and interior modules are disposed substantially in registration.

2. An antenna as defined in claim 1 adapted for operation at frequencies of from about 1.5 GHz to about 2.4 GHz.

3. An antenna as defined in claim 2, wherein said elongated coaxial radiating element is selected from the group consisting essentially of semi-rigid coaxial sleeve dipole radiators and collinear array radiators.

4. An antenna as defined in claim 2, wherein each of said first and second dielectric resonators has a cylindrical configuration and is adapted for TE011 mode coupling.

5. An antenna as defined in claim 2, wherein each of said first and second dielectric resonators have a square configuration and is adapted for TE111 mode coupling.

6. An antenna as defined in claim 4, wherein said first and second dielectric resonators have a length to diameter ratio of less than about 0.4.

7. An antenna as defined in claim 4, adapted for use at operating frequencies of between about 1.5 GHz to about 2.2 Ghz wherein each of said first and second dielectric resonators has a dielectric constant of from about 75 to about 100 and a Q factor of at least about 3000.

8. An antenna as defined in claim 7, wherein said first and second dielectric resonators are barium and titanium-based oxide ceramic resonators including at least one Lanthanide Series component and optionally a lead component.

9. An antenna as defined in claim 4 adapted for use at operating frequencies of at least about 2.2 Ghz wherein said first and second dielectric resonators comprise Zr-Sn-Ti ceramic resonators having a dielectric constant of from about 20 to about 45 and a Q factor of at least about 40.000/f, where f is in Ghz.

10. An antenna as defined in claim 1, mounted on a vehicle windshield having a thickness of about 6 mm and operating at frequencies of between about 1.7 Ghz to about 1.9 GHz which exhibits coupling losses of less than about 1.5 Db.

11. An antenna as defined in claim 8, wherein said first and second dielectric resonators include cylindrical ceramic resonators having a dielectric constant of greater than or equal to about 80 operating at about 1.8 GHz and having a diameter of about 24 mm and a height of about 7.6 mm.

12. An antenna as defined in claim 1, further comprising a first exciter element disposed in said first shielded cavity of said exterior module, said first exciter element including a first strip of electrically conductive material disposed adjacent a surface portion of said first dielectric resonator, said first exciter strip being electrically connected to said core conductor of said radiating element; and a second exciter element disposed in said second shielded cavity of said interior module, said second exciter element including a second strip of electrically conductive material disposed adjacent a surface portion of said second dielectric resonator, said second exciter strip being electrically connected to said core conductor of said coaxial feed line.

13. An antenna as defined in claim 12, wherein said first exciter strip is mounted to a first major surface of said first dielectric resonator which extends opposite and parallel to said vehicle window outside surface, and said second exciter strip is mounted to a second major surface of said second dielectric resonator which extends opposite and parallel to said vehicle window inside surface.

14. An antenna as defined in claim 12, wherein said first exciter strip is mounted to a first side surface of said first dielectric resonator which extends generally normal to said vehicle window outside surface, and said second exciter strip is mounted to a second side surface of said second dielectric resonator which extends generally normal to said vehicle window inside surface.

15. An antenna as defined in claim 13 wherein said first exciter strip is defined on a first printed circuit substrate disposed within said first shielded cavity and said second exciter strip is disposed on a second printed circuit substrate disposed within said second shielded cavity.

16. An antenna as defined in claim 15, wherein each of said first and second printed circuit substrates includes respective first and second means for respectively positively positioning said first and second dielectric resonators with respect to said first and second shielded cavities and said exterior and interior modules.

17. An antenna as defined in claim 16, wherein said first dielectric resonator includes a first core aperture and said first positioning means includes a first central projection extending normally from said first printed circuit substrate surface and said second dielectric resonator includes a second core aperture and said second positioning means includes a second central projection extending normally from said second printed circuit substrate.

18. An antenna as defined in claim 1, wherein said means for mounting said exterior module and said interior module to opposing surfaces of a vehicle window comprises adhesive means.

19. An antenna as defined in claim 1, further including a first dielectric cap member releasably engaging said first non-conductive housing and a second dielectric cap member releasably engaging said second non-conductive housing, said first and second dielectric cap members effectively closing off openings to said first and second shielded cavities, respectively, and further respectively maintaining said exterior and interior modules in an assembled form.

20. An antenna as defined in claim 1, wherein said first and second electrically non-conductive module housings comprise a molded thermoplastic polymer housing.

21. An antenna as defined in claim 12, wherein said first and second exciter strips have a waveguide wavelength of less than about 0.25 waveguide wavelength.

22. An antenna as defined in claim 12, wherein an impedance is formed between said first and second exciter strips and an adjacent end wall portion of said respective first and second electrically conductive shroud members to match the required antenna base impedance.

23. An antenna as defined in claim 22, wherein the width of said first and second exciter strips may be selected to provide an impedance required to match an antenna base impedance of between about 30 Ohms to about 120 Ohms.

24. An antenna as defined in claim 1, wherein said first and second dielectric resonators include ceramic resonators having a generally square configuration.

25. An antenna as defined in claim 24, wherein said first and second dielectric resonators have dimensions of about 23 mm by about 23 mm by about 7.1 mm.

26. An antenna as defined in claim 1, wherein said first and second dielectric resonators are ceramic.

27. A method for coupling an omnidirectional antenna to a utilization device in a vehicle, said method comprising: providing an elevated feed radiating element, providing a pair of dielectric resonators, disposing a first of said resonators on an outside surface and a second of said resonators on an inside surface of a window of said vehicle in generally opposing, registering relationship, electrically coupling said radiating element to the first resonator, electrically coupling a utilization device within the vehicle to the second resonator and coupling RF energy through the window by resonance mode coupling of said first and second resonators.

28. An antenna apparatus for mounting on a window of a vehicle and adapted for operation in conjunction with a utilization device within the vehicle, said antenna apparatus comprising:

an exterior module including a first electrically conductive shroud member defining a first shielded cavity, an elongated radiating element; a first dielectric resonator adapted for resonant mode coupling disposed in said first shielded cavity, means for electrically coupling said radiating element to said first dielectric resonator, and means for mounting said exterior module to an outside surface of said vehicle window with said radiating element disposed in an elevated feeding position; and an interior module including a second electrically conductive shroud member defining a second shielded cavity, a second dielectric resonator disposed in said second shielded cavity and adapted for resonant mode coupling with said first dielectric resonator, a coaxial feedline including an inner conductor and an outer conductive shield for electrically coupling said interior module to said device, said inner conductor being electrically coupled to said second dielectric resonator, said outer conductive shield being electrically coupled to said second conductive shroud member; and means for mounting said interior module to an inside surface of said vehicle window in general alignment with said exterior module such that the first dielectric resonator and the second dielectric resonator are disposed substantially in registration.

29. An antenna apparatus for mounting on a window of a vehicle and adapted for operation in conjunction with a utilization device within the vehicle, said antenna apparatus comprising:

an exterior module including an elongated radiating element; a first dielectric resonator adapted for resonance mode coupling, means for electrically coupling said radiating element to said first dielectric resonator, and means for mounting said exterior module to an outside surface of said vehicle window with said radiating element disposed in an elevated feeding position; and an interior module including a second dielectric resonator adapted for resonance mode coupling with said first dielectric resonator element, a coaxial feedline for electrically coupling said interior module to said device including an inner conductor, said inner conductor being electrically coupled to said second dielectric resonator; and means for mounting said interior module to an inside surface of said vehicle window in general alignment with said exterior module such that the first dielectric resonator and the second dielectric resonator are disposed substantially in registration.

30. A glass mount antenna assembly for mounting on opposite sides of a glass interfacial member and adapted for operation at frequencies greater than or equal to about 1.5 GHz in conjunction with a utilization device on one side of the interfacial member, the antenna assembly comprising:

a first module, the first module having means for mounting said first module on a first side of said interfacial member, said first module including a non-conductive first housing, a conductive first shroud member disposed within said first housing and defining a first shielded cavity within said first housing, an elongated coaxial radiating element mounted to said first housing, the coaxial radiating element including a core conductor portion and a shielding portion, said antenna assembly further including a first dielectric resonator adapted for resonance mode coupling disposed in said first shielded cavity, means for connecting said radiating element core conductor portion to said first dielectric resonator, means for connecting said radiating element shielding portion to said first shroud member; and, a second module, the second module having means for mounting said second module on a second side of said glass interfacial member in alignment with said first module, said second module including a non-conductive second housing, a conductive second shroud member disposed in said second housing and defining a second shielded cavity within said second housing, a second dielectric resonator adapted for resonance mode coupling disposed in said second shielded cavity, a coaxial feedline including a core portion and an outer shield portion, the core portion being connected to said second dielectric resonator, said outer shield portion being connected to said second shroud member, said first and second modules being mounted upon said glass interfacial member such that said first and second dielectric resonators are disposed on said first and second sides of said glass interfacial member in substantial registration with each other.

31. A method for coupling an omnidirectional antenna mounted on an interface member to a utilization device disposed on one side of the interface member, comprising:

providing first and second dielectric resonators;

locating the first dielectric resonator on a first surface of said interface member, locating the second dielectric resonator on a second surface of said interface member opposite said first dielectric resonator such that said first and second dielectric resonators are in substantial registration with each other;

providing a radiating element and electrically coupling the radiating element to said first dielectric resonator;

electrically coupling the utilization device to said second dielectric resonator; and, coupling radio-frequency energy through the interface member by resonance mode coupling of said first and second resonators.

32. An antenna apparatus for mounting on a window of a structure and adapted for operation in conjunction with a utilization device within the structure, the antenna apparatus comprising:

an exterior module and an interior module mounted on respective exterior and interior surfaces of the window in general alignment with each other, the exterior module having an elongated radiating element, a first dielectric resonator adapted for resonance mode coupling, means for electrically coupling said radiating element to said first dielectric resonator and means for mounting said exterior module to the exterior surface of the window with said radiating element disposed in a feeding position, the interior module including a second dielectric resonator adapted for resonance mode coupling with said first dielectric resonator, a coaxial feedline for electrically coupling said interior module to said utilization device, the coaxial feedline including an inner conductor, the coaxial feedline inner conductor being electrically coupled to said second dielectric resonator, and means for mounting said interior module to said window interior surface, said exterior and interior modules being aligned with each other such that said first and second dielectric resonators are in substantial registration with each other.

* * * * *